United States Patent [19]

Amancharla et al.

[11] 4,051,896

[45] Oct. 4, 1977

[54] WELL BORE LINER HANGER

[75] Inventors: Amareswar Amancharla, Dallas; Carter R. Young, Lewisville, both of Tex.

[73] Assignee: Otis Engineering Corporation, Dallas, Tex.

[21] Appl. No.: 668,288

[22] Filed: Mar. 18, 1976

Related U.S. Application Data

[62] Division of Ser. No. 533,935, Dec. 18, 1974, Pat. No. 3,946,807.

[51] Int. Cl.[2] ..... E21B 23/02; E21B 43/10

[52] U.S. Cl. ..... 166/123; 166/182; 166/208

[58] Field of Search ..... 166/123–125, 166/181, 182, 208

[56] References Cited

U.S. PATENT DOCUMENTS

| | | | |
|---|---|---|---|
| 3,460,617 | 8/1969 | Brown et al. | 166/208 |
| 3,468,375 | 9/1969 | States | 166/124 |
| 3,856,081 | 12/1974 | Canalizo | 166/123 |
| 3,893,717 | 7/1975 | Nelson | 166/208 |

*Primary Examiner*—James A. Leppink
*Attorney, Agent, or Firm*—H. Mathews Garland

[57] ABSTRACT

Precompletion apparatus for use in air drilling and casing a problem formation in a well including a casing landing nipple at the lower end of a first string of solid well casing installed by suitable conventional techniques, an expendable plug for engagement in the casing landing nipple to plug a well bore after air drilling below the casing landing nipple to control the well during inserting of a slotted liner, an expending shoe for engaging and displacing the plug downwardly from the landing nipple, a slotted well bore casing for lining a well bore along a problem formation which has been air drilled, and a casing hanger for supporting the slotted liner along the air drilled portion of the well bore from the landing nipple. The plug and hanger each have locking keys engageable with a casing landing nipple and expandable seals for sealing with a seal surface along the casing landing nipple. The expendable plug is used to close the well bore above the air drilled portion for pressure conrol while lowering the liner into the well bore. The plug is engaged and lowered in the well bore by the expending shoe which is supported on the lower end of the liner. The liner is lowered into the air drilled section of the well bore and supported from the casing landing nipple by the hanger. The plug remains supported from the lower end of the liner after installation of the liner.

4 Claims, 16 Drawing Figures

WELL BORE LINER HANGER

This is a divisional application of application Ser. No. 533,935 filed Dec. 18, 1974, now U.S. Pat. No. 3,946,807.

This invention relates to well tools and more particularly relates to apparatus for use in air drilling and lining a well bore along a particularly troublesome earth formation.

In the drilling of wells, particularly oil and gas wells, the normal procedure is to pump a drilling fluid which normally is a mud-like liquid generally containing water into the formation to wash the drilled cuttings up the well bore around the drill bit and drill pipe and to impose a hydrostatic head on the formations being drilled so that any natural formation pressure encountered in drilling into oil and gas bearing formations will be safely contained until the drilling process is completed and the well is properly equipped to control the fluid pressures. Occasionally an earth formation is encountered which presents extremely formidable obstacles to continued normal drilling. One such type formation is the Mesa Verde found in the state of Colorado which is a heaving shale or bentonitic formation including a type of clay which swells when contacted by water. When such a formation is initially drilled into the drilling will proceed in the normal manner for the first several hours of drilling during which water in the drilling fluid soaks from the bore hole into the formation around the hole. The formation then swells causing the drill bit and pipe to stick if drilling is continued. If the drill bit and pipe are pulled from the bore hole the formation may swell to the extent that the previously drilled hole essentially closes. Oftentimes in practice such formations have been drilled over periods of many months with efforts to complete a well having to be abandoned. In one known instance of such a problem a well was drilled for a period of seven months without success in completing it. It has been found, however, that formations comprising heaving shale may be successfully drilled using a fluid such as air for circulation through the well bore to wash out the cuttings and maintain the desired pressure on the formations being drilled. The air does not cause the heaving shale to swell as does water containing drilling mud. After such air drilling the well is cased with a slotted liner. The liner generally is quite long and cannot be inserted using conventional apparatus to close the well at the surface as the well could not be kept under pressure control due to flow which would occur through the slotted liner at the wellhead.

It is a particularly important object of the invention to provide new and improved apparatus for air drilling and precompleting a well in problem formations.

It is another object of the invention to provide an expendable plug, a slotted liner, a liner hanger, and related handling tools for use in precompleting an air drilled well bore.

It is another object of the invention to provide apparatus for controlling a well under pressure while inserting a slotted liner into a lower portion of the well bore.

In accordance with the invention there is provided apparatus for air drilling and precompleting a well bore which includes a casing landing nipple secured at the lower end of conventional casing placed in a well bore above a problem formation, an expendable plug securable in the casing landing nipple for shutting in the well bore above an air drilled lower portion of the well bore, a slotted well bore liner for installation along the air drilled portion of the well bore, an expending shoe connected to the lower end of the slotted liner for engaging and moving the expendable plug downwardly in the well bore as the liner is installed, a liner hanger secured with the upper end of the slotted liner for supporting the slotted liner in the air drilled portion of the well bore from the casing landing nipple, and handling tools for installing the expendable plug and the well bore. The expendable plug and liner hanger each have expendable and contractable locking keys engageable with the casing landing nipple and expendable seals for sealing with a seal surface along the casing landing nipple. The expendable plug includes a pressure equalization feature for equalizing the pressure across the plug preliminary to disengaging and lowering the plug into the air drilled portion of the well bore.

A more thorough understanding of the details of a preferred embodiment of the apparatus of the invention together with the foregoing objects and advantages will be obtained from reading the following detailed description taken in conjunction with the accompanying drawings wherein.

Figure 1:
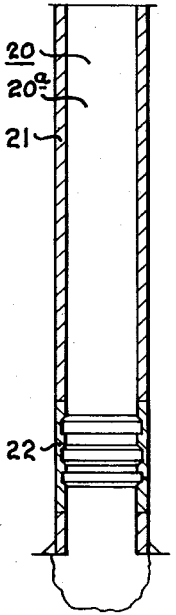
FIG. 1 is a schematic view in section and elevation showing a well bore drilled with the apparatus of the invention at the end of the first stage of drilling and liner installation above a problem zone in the formation being drilled.
Figure 2:
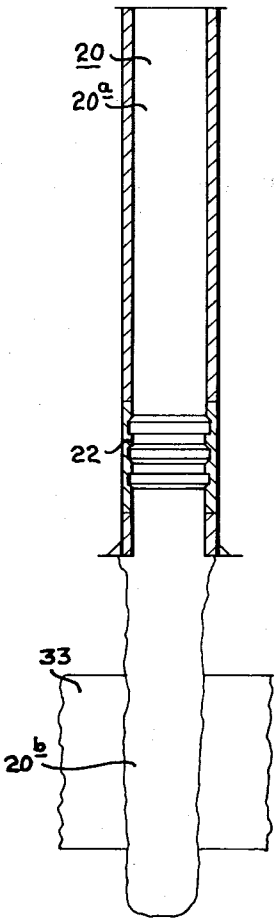
FIG. 2 is a schematic view similar to FIG. 1 illustrating the completion of a second phase of air drilling the well bore through the problem zone in accordance with the invention.
Figure 3:
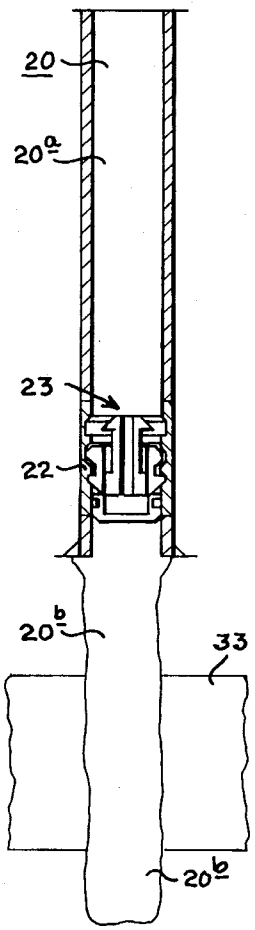
FIG. 3 is a schematic view similar to FIGS. 1 and 2 showing an expendable plug installed in the well bore to contain well pressure within the well bore below the plug after the completion of the air drilling step.
Figure 4:
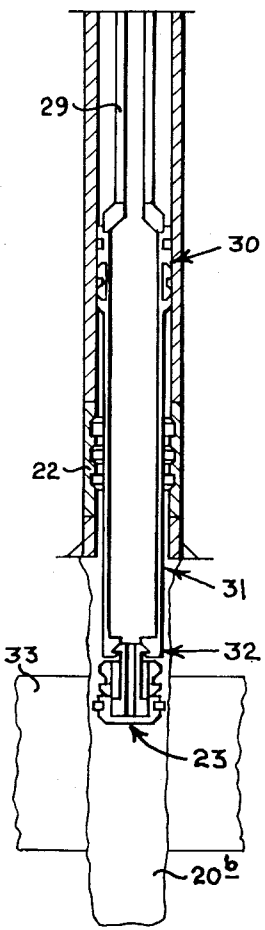
FIG. 4 is a schematic view similar to FIGS. 1–3 illustrating an intermediate stage in the installation of the liner hanger, the slotted liner, and the removal and lowering of the expendable plug.
Figure 6A:
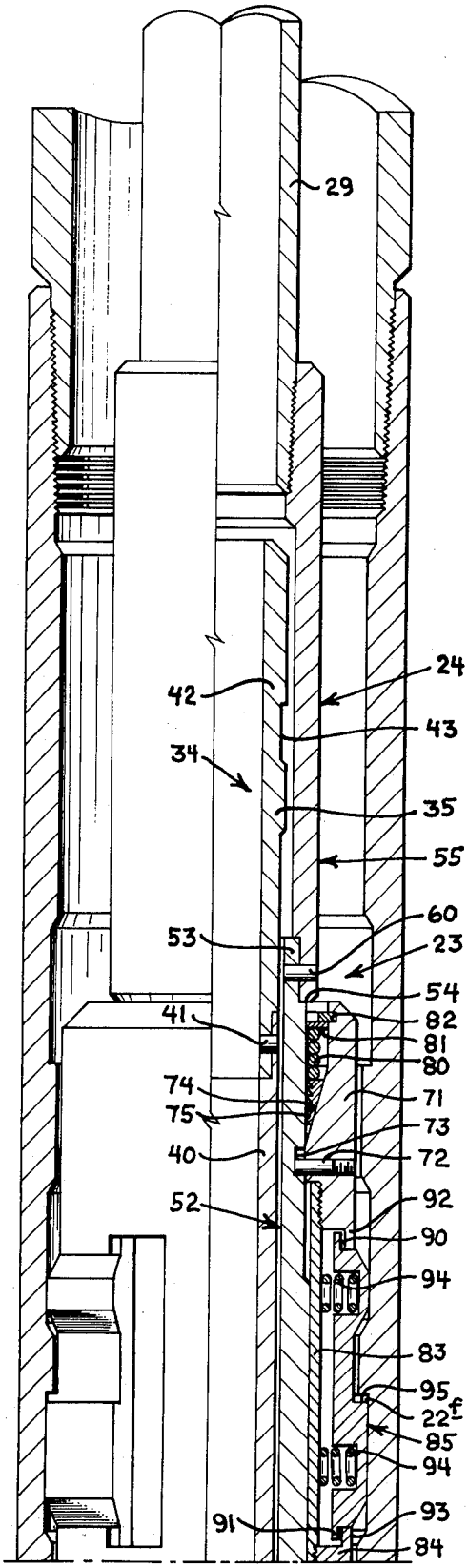
Figure 6B:
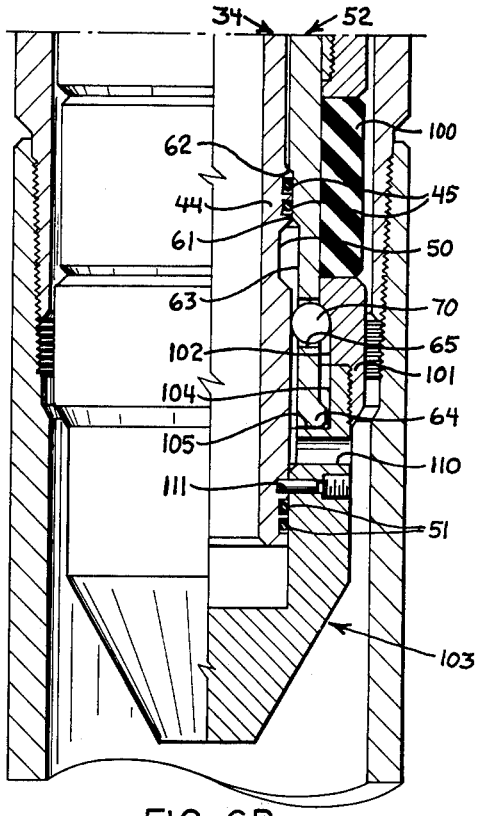
Figure 7A:
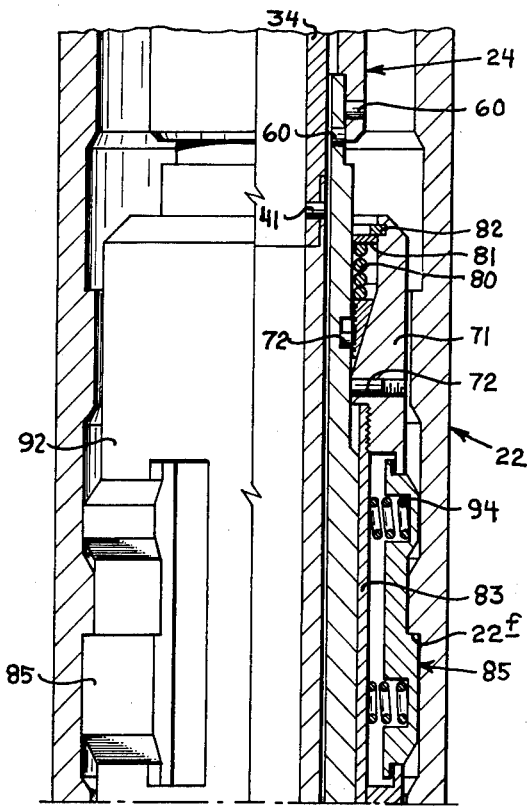
Figure 7B:
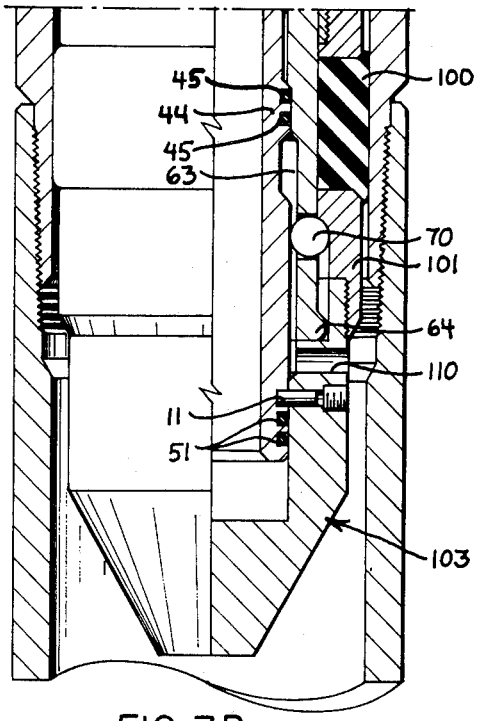
Figure 9:
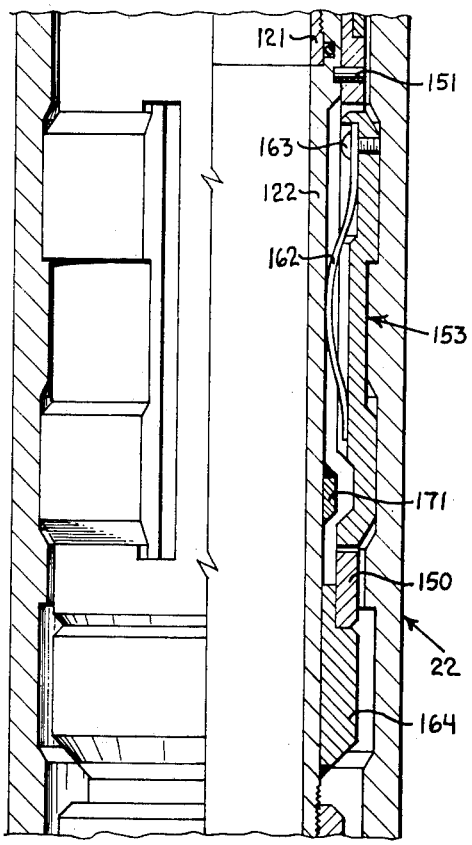
Figure 10A:
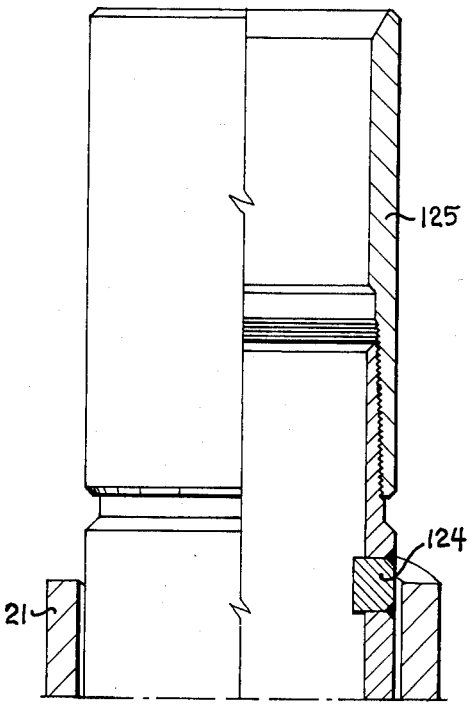
Figure 10B:
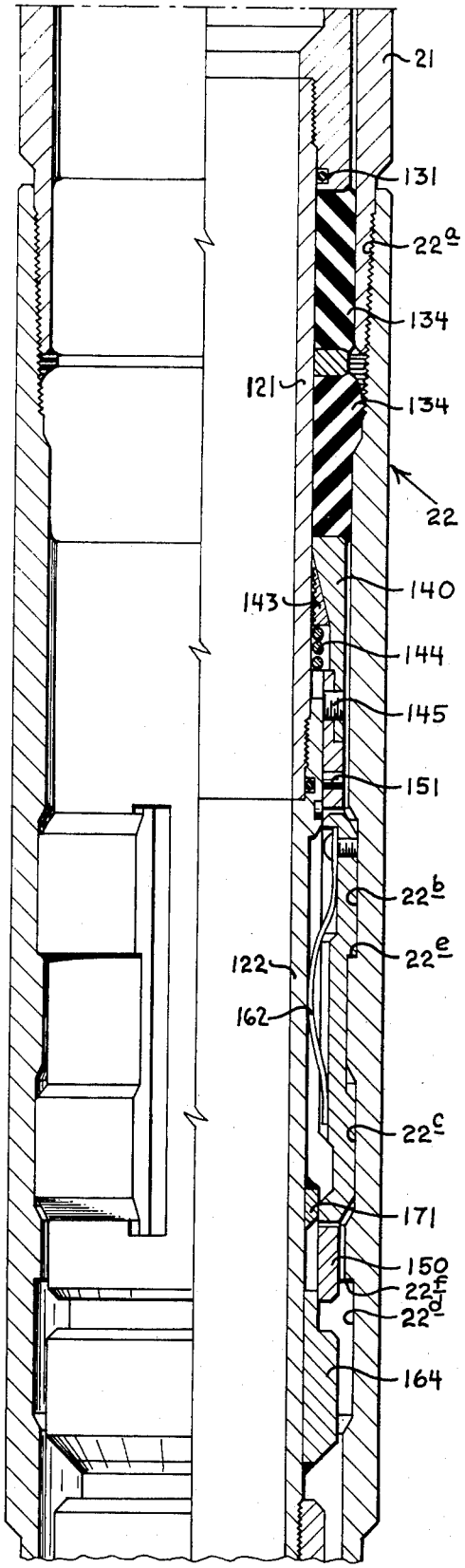

FIGS. 6A and 6B taken together constitute a fragmentary view in section and elevation of an expendable plug coupled with a running tool in accordance with a preferred embodiment of the invention;

FIGS. 7A and 7B taken together constitute a fragmentary view in section and elevation of the expendable lug fully set in the casing landing nipple at the lower end of the first string of casing installed in the well bore;

FIGS. 8A, 8B, 8C, and 8D taken together constitute a fragmentary broken view in section and elevation showing a running tool, a liner hanger, a slottted well bore liner, a plug expending shoe, and the expendable plug coupled together during the running procedure represented in FIG. 4;

FIG. 9 is a fragmentary view in section and elevation illustrating the locking dogs on the liner hanger expanded into the casing landing nipple preliminary to locking the hanger at the landing nipple and expansion of the hanger seals; and FIGS. 10A and 10B taken together constitute a fragmentary view in section and elevation showing the liner hanger fully locked with the seal expanded in the casing landing nipple and the handling tool removed.

Figure 8A:
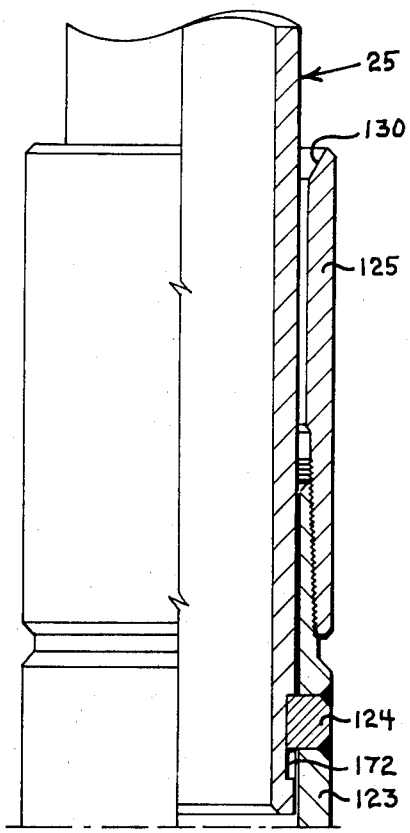

Referring to the drawings a well bore 20 is drilled in accordance with the invention using a combination of conventional mud and air drilling techniques utilizing equipment for lining the well bore which includes a first upper string of well casing 21 including a casing landing nipple 22, an expendable plug 23, a plug running tool 24, FIG. 6A, a liner hanger running tool 25, FIG. 8A, a liner hanger 30, a slotted liner 31, and a plug expending shoe 32. In accordance with the invention the well bore 20 is drilled by conventional techniques using drilling mud to drill a first upper portion of a well bore 20 after which a suitable string of well casing 21 including a casing landing nipple 22 is installed in the well bore. The well is drilled using drilling mud to a depth of within about two hundred feet of the formation which is expected to present a drilling problem. The well is then air drilled through the casing 21 downwardly through the problem formation 33 forming a lower air drilled well bore **20*b*. The expendable plug 23 is installed in the well bore at the landing nipple 22 to confine the air pressure within the well bore portion 20*b* below the plug while the well bore is opened above the plug to admit the casing liner 31. The expending shoe 32 is secured on the lower end of the liner while the casing hanger 30 is connected with the upper end of the liner. The casing hanger is coupled with the handling tool 25 supported from a work string 29 of tubing or drill pipe for lowering the casing hanger liner and expending shoe downwardly in the well bore. After the casing hanger is lowered into the well, pressure control means such as blowout preventers, not shown, are closed at the wellhead around the work string to keep the well under control during the lowering of the slotted liner. The plug 23 is engaged by the expending shoe forcing the plug downwardly from the casing nipple while supporting the plug from the shoe. The plug, shoe, liner, and hanger are lowered until the liner is within the lower air drilled well bore portion 20*b* with the liner being permanently installed supported by the hanger from the casing nipple 22**.

Referring to FIGS. 10A and 10B, the casing landing nipple 22 is a conventional tubular member having upper internal threads **22*a* for connection with the casing string 21 and an internal locking recess profile which includes an upper internal annular recess 22*b*, a middle recess 22*c*, and a lower recess 22*d*. At the lower end of the recess 22*b* the landing nipple is provided with an internal annular stop shoulder 22*e* for supporting the well tools locked in the nipple against downward movement. The landing nipple permits the releasable locking of the plug 23 and the hanger 30 at the lower end of the upper string of well casing 21**. The use of the multiple recess profile in the landing nipple permits selectivity in the use of the nipple in the sense that only locking keys which have a compatible boss profile may be landed and locked in the nipple while other locking keys on well tools will pass through the nipple during well operations.

Referring to FIGS. 6A and 6B the expendable plug 23 has an inner mandrel 34 formed by a tubular head member 35 and a main body member 40 telescoped together and secured by a pin 41. The head 35 has an enlarged upper portion 42 provided with an external annular locking recess 43. The main body member has an upper external annular seal boss 44 which supports a pair of seal rings 45, an external annular release recess 50 below the boss 44, and a pair of lower seal rings 51 supported around the lower end portion of the body. The expendable plug has an outer mandrel 52 which is slidably fitted over the inner mandrel 34. The outer mandrel 52 has a reduced upper end portion 53 providing an upwardly facing external annular stop shoulder 54 for the connection of a running tool 55 which is secured with the outer mandrel by a shear pin 60. As shown in FIG. 6B the outer mandrel 52 has an internal annular seal recess 61, the upper end of which defines a downwardly facing stop shoulder 62 within the outer mandrel. The recess 61 receives the seal boss 44 and the ring seal 45 for sealing between the inner and outer mandrels at the relative positions of the mandrels shown in FIGS. 6A and 6B. The lower end portion of the outer mandrel 52 has an internal annular recess 63 and an external annular flange 64. The mandrel 52 is provided with circumferentially spaced lateral bores 65 in each of which is positioned a locking bail 70. An annular locking head and key retainer 71 is secured on the upper end portion of the outer mandrel 52. The head 71 is connected by a shear pin 72 with the mandrel 52. The shear pin 72 extends through the head 71 into an external recess 73 formed in the outer surface of the mandrel 52. The head 71 has an internal annular upwardly opening conical recess 74 which holds a plurality of circumferentially positioned slips 75 each having a toothed internal surface for gripping the outer surface of the mandrel 52 to hold the mandrel against downward movement relative to the head 71. A coil spring 80 is disposed in the recess 74 between the upper ends of the slips 75 and a spacer ring 81 which is held against the spring by an internal lock ring 82 secured within the upper end portion of the head 71. The head 71 is threaded onto a sleeve 83 which fits in sliding relationship around the outer mandrel 52. The lower end of the sleeve 83 is threaded into a lower key retainer 84. A plurality of locking keys 85 are disposed around the sleeve 83 between the head 71 and the lower key retainer 84 for releasably supporting the expendable plug at a locking recess such as in the casing landing nipple 22. The keys 85 have upper and lower retainer flanges 90 and 91 which are held by corresponding flanges 92 and 93, respectively, on head 71 and the lower key retainer 84. The keys 85 are biased outwardly by springs 94 fitted within internal recesses of the keys around the sleeve 83. Each of the keys has an external locking boss profile which is compatible with the locking recesses **22*c* and 22*d* in the casing landing nipple 22 for locking the expendable plug against upward movement in the casing. The keys 85 have upwardly facing locking shoulders 95 which are engageable with the downwardly facing internal annular locking shoulder 22*f* in the landing nipple 22. The keys 85 are biased constantly outwardly by the springs 94 and serve to properly locate the expendable plug at a compatible landing nipple recess and hold the plug against movement in the desired direction which in the present instance is against upward movement. It will be recognized that the keys 85 cannot be locked or wedged outwardly and thus are pressed inwardly upon downward movement of the plug in passing or being forced from a locking recess. Sufficient lateral movement is permitted the keys 85** so that the keys will freely slide along the inner wall surfaces of a tubing or casing string and will expand into the desired locking recess.

As seen in FIG. 6B the expendable plug 23 has an external annular seal 100 disposed on the outer mandrel 52 between the key retainer 84 and a ring member 101. The member 101 has an internal locking recess 102 which receives the outer portions of the locking ball 70 during the steps in the operation of the plug when the seal 100 is relaxed as shown in FIG. 6B and when the seal is expanded as in FIG. 7B. The ring member 101 is threaded onto the upper end of a bottom nose member 103 which has an upper internal annular recess 104 providing an upwardly facing stop shoulder 105. The lower end portion of the outer mandrel 52 extends into the recess 104 with the lower end edge of the mandrel engaging the stop shoulder 105 at the relative position of the plug members shown in FIG. 6B. The nose member 103 has a pressure equalization side port 110. The member 103 is secured by a shear pin 111 to the lower end of the inner mandrel 34 of the expendable plug. By manipulation of the inner and outer mandrels 34 and 52 of the expendable plug the plug may be set and released during the initial and final phases of the operation of the well apparatus as described in more detail hereinafter. The plug is designed to isolate the lower air drilled portion **20*b* of the well bore from the upper portion 20*a* to confine the air drilling fluid pressure within the well bore below the plug prior to running in the slotted liner 31.**

Figure 8B:
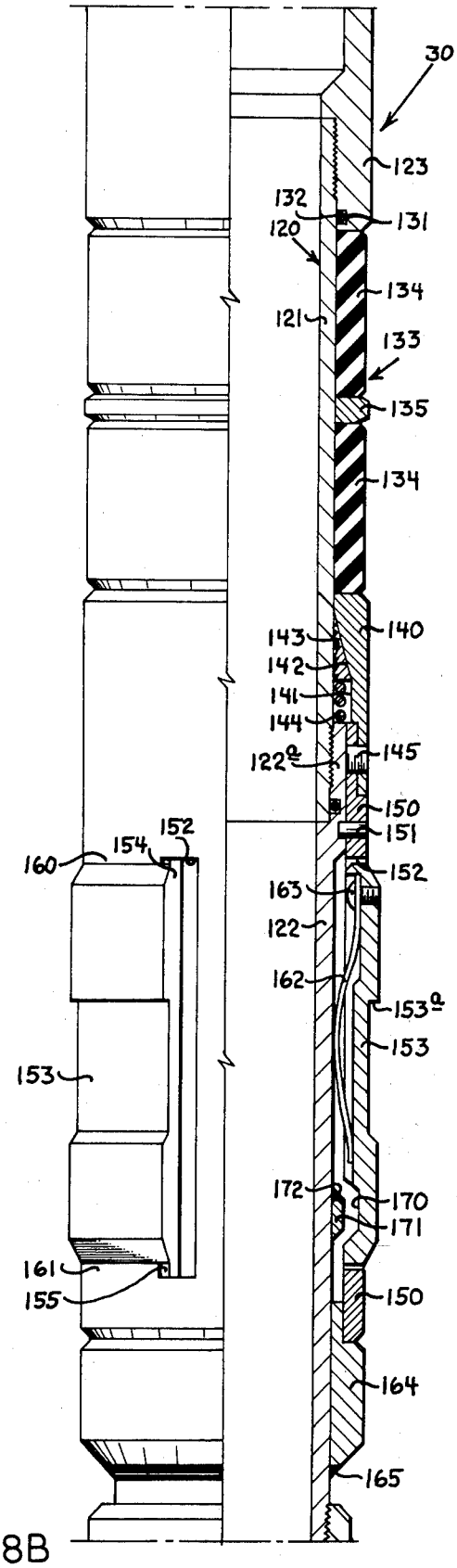

The liner hanger 30 used to support the slotted liner 31 in the well bore from the casing landing nipple 22 is illustrated in detail in FIGS. 8A and 8B which show the hanger as it is run into the well bore and in FIGS. 10A and 10B illustrating the hanger locked in the casing landing nipple 22. Referring to FIGS. 8A and 8B the liner hanger 30 includes a tubular body mandrel 120 formed by an upper mandrel section 121 and a lower mandrel section 122. The upper mandrel section is threaded into a head member 123 which is provided with an inwardly extending handling lug 124. A guide head 125 is threaded on the upper end of the head member 123 provided with an inwardly sloping upper end guide surface 130 to guide a handling tool such as the tool 25 into the upper end of the liner hanger. A ring seal 131 is carried by the head member 123 within an internal annular recess 132 at the lower end of the member to seal between the mandrel section 121 and the head member 123. A seal assembly 133 including upper and lower identical seals 134 separated by a spacer ring 135 is disposed on the mandrel section 121 below the head member 123. An annular slip retainer and seal assembly support member 140 is mounted on the mandrel section 121 below the seal assembly 133. The member 140 has an internal annular recess 141 which includes a conical upper portion 142 which holds a plurality of circumferentially spaced slips 143. The slips 143 are biased upwardly by a spring 144 so that the toothed inner surfaces of the slips engage the outer surface of the mandrel section 121 to resist upward movement of the mandrel which tends to tightly wedge the slip within the conical recess portion 142 between the mandrel section and the member 140. The member 140 is secured by a pin 145 to a tubular key mandrel 150 which is connected along an upper end portion by a shear pin 151 to the slightly enlarged head portion **122*a* of the mandrel section 122. The key mandrel has a pair of longitudinal windows 152 each of which accommodates a locating and locking key 153 which has an outer profile compatible with the inner profile of the casing landing nipple 22 for locating the liner hanger at and locking the hanger in the landing nipple. Each of the keys 153 has upper and lower retainer flanges 154 and 155 which extend behind lip portions 160 and 161 on the key mandrel 150 projecting into the windows 152 for retaining the keys with the mandrel and permitting the keys to move radially inwardly and outwardly. Each of the keys is biased radially outwardly by a leaf spring 162 secured at an upper end by a screw 163 within the key. The lower end of the key mandrel 150 is supported on a tubular member 164 secured as by welding at 165 to the lower hanger mandrel section 122. Each of the keys has an internal release recess 170 permitting each key to compress inwardly to a release position in the position of the hanger mandrel illustrated in FIG. 8B. The hanger mandrel section 122 is provided with an external annular locking flange 171 secured as by welding at 172 on the mandrel section. When the hanger mandrel is driven downwardly relative to the keys for expanding the seal elements 134 the lower end 122*a* of the head of the lower mandrel section 122 is aligned behind the upper ends of the keys and the key locking flange 171** is aligned behind the lower ends of the keys preventing compression of the keys so that the keys will not release from a landing nipple locking recess.

As shown in FIG. 8A the liner hanger 30 is coupled with a handling tool 25 which is a tubular member such as a pipe section having an external J-slot to receive the handling lug 124 of the head member 123 on the liner hanger. The J-slot feature comprises an inverted J-shaped recess which is a standard handling tool feature wherein the vertical portion of the J-slot opens downwardly to permit entry of the handling lug 124 into the slot and the handling tool is rotated to align the handling lug in the curved closed end portion of the slot so that the liner hanger may hang by means of the lug engaged in the slot from the handling tool. Such J-slot arrangements are shown in detail in illustrations at page 3951 of the *Composite Catalog of Oilfield Equipment and Services,* 1974–75 *Edition,* published by World Oil, Houston, Tex. The lower end of the liner hanger mandrel section 122 is threaded into the upper end portion **31*a* of the slotted liner 31.**

Figure 8C:
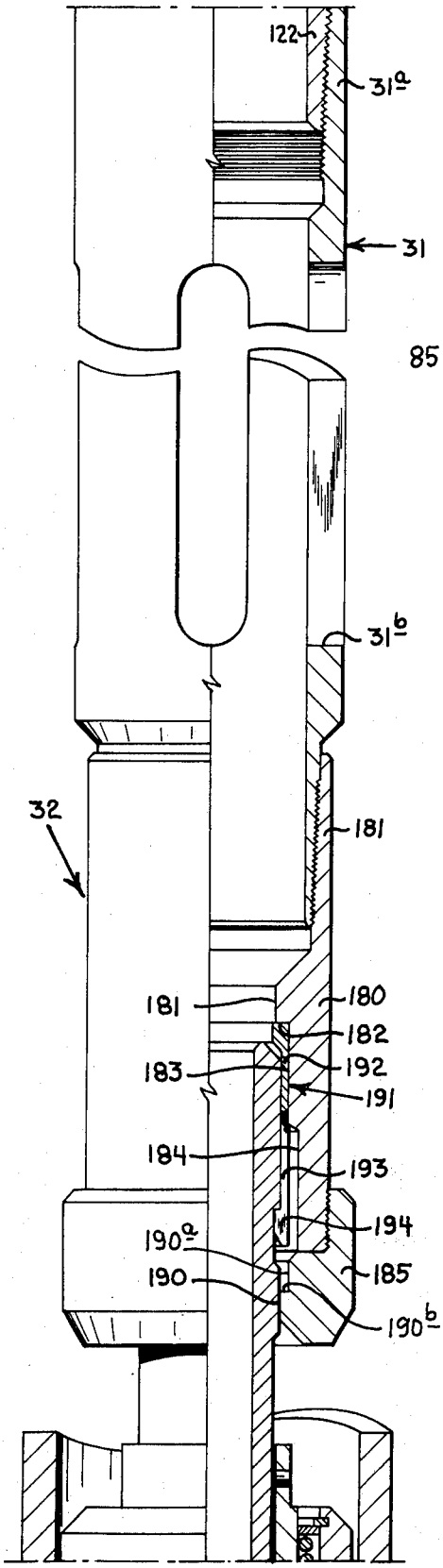
Figure 8D:
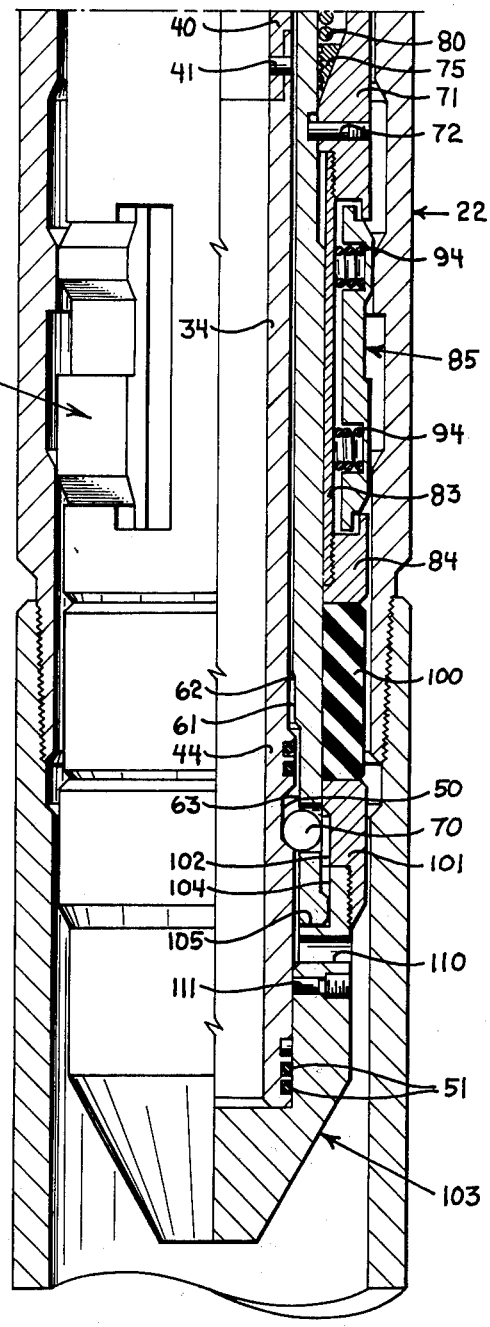

As represented in FIG. 8C the slotted liner 31 is a tubular well casing member which has a plurality of elongated narrow slots **31*b*** distributed circumferentially along the length of the liner to provide lateral support along the well bore wall for the formation while permitting substantial well fluid flow into the well bore from the formation. Thus the liner provides substantial formation wall support along the well bore while permitting ready flow of well fluids into the well bore from the formation.

The lower end of the liner 31 is threaded into the expending shoe 32 which is used to engage, remove, and support the expendable plug 23 when installing the liner in the well bore. The detail features of the expending shoe are shown in FIG. 8C which illustrates the shoe coupled with the inner mandrel of the plug 23 as the plug is released from the casing landing nipple 22 and pushed downwardly in the well bore. the expending shoe includes a tubular housing 180 having an enlarged head end portion 181 threaded on the lower end of the liner. The housing 180 has an internal flange **181*a* defining a downwardly facing stop shoulder 182 at the upper end of an upper recess 183 which is concentric with a larger lower recess 184 opening through the lower end of the housing. The lower end of the housing is threaded into a retainer 185 which has a bore 190 forming a sliding fit with the inner mandrel of the plug 23. A collet 191 is disposed within the bore of the housing 180 for coupling the expending shoe with the plug mandrel. The collet has an annular head portion 192 which fits within the upper bore portion 183 of the housing and has dependent circumferentially spaced collet fingers 193 having locking heads 194 sized to engage the locking recess 43 of the inner mandrel 34 of the expendable plug. The retainer 185 has an enlarged bore portion 190***a* defining an upwardly facing stop shoulder 190*b*. When the expending shoe 32 is lifted as seen in FIG. 8C, the collet heads 194 move into the bore portion 190*a* against the shoulder 190*b* holding the heads inwardly locked on the upper end of the mandrel 34.

The well tools and equipment illustrated in the drawings are used to carry out an air drilling process and precomplete a well in particularly troublesome areas such as bentonitic formations. In the first step of the process using such tools and equipment the well bore 20 is drilled with conventional techniques such as using liquid drilling mud to form the bore hole portion 20*a*. This portion of the bore hole is drilled to within as close as 200 feet to what is expected to be the troublesome formation. The location of the troublesome formation 33 as it is designated in the drawings is generally based on past drilling experience in the particular area of the well. After completion of the standard drilling procedures recognized steps are followed to install the tubular well casing 21 which includes substantially at the lower end of the casing the casing landing nipple 22. After completion of drilling with the liquid mud the liquids are removed from the bore hole and the hole is made as dry as possible. Air drilling techniques are then used to advance the hole through the troublesome formation 33 forming the lower portion 20*b* of the hole. The air drilling techniques include circulating air downwardly through the drill string, outwardly through the drill bit and back up the bore hole through the annulus between the bore hole wall and the drill string. The air is pumped at a sufficient velocity to lift the cuttings to the surface in the usual manner.

At the completion of the air drilling phase forming the bore hole the expendable plug 23 is installed in the landing nipple at the lower end of the casing string 21 to shut in the lower portion of the bore hole which had been air drilled confining air under pressure within such bore hole portion. The expendable plug 23 is connected with the running tool 24 by means of the shear pin 60 as shown in FIG. 6A. The running tool is conncted on a handling string 29 used to lower the plug in the well bore. The seal 100 of the plug is relaxed as shown in FIG. 6B with the outer mandrel 52 of the plug being secured by the shear pin 73 to the head member 71 while the inner mandrel 34 of the plug is secured by the shear pin 111 to the outer mandrel. The plug and handling string are lowered through suitable pressure confining apparatus such as blowout preventers, not shown, at the wellhead to confine the air pressure within the well bore while the plug and handling string are being lowered. The plug is lowered through the casing landing nipple 22 and then lifted upwardly to latch the keys 85 in the landing nipple recesses. All of the downwardly facing surfaces on the keys 85 taper upwardly and outwardly whereby the keys readily move downwardly as the plug passes through the landing nipple. The only abrupt locking shoulder on the keys is the upwardly facing surface 95. As the plug is lifted upwardly back into the landing nipple the keys expand outwardly into the locking recesses of the nipple with the shoulder 95 on each of the keys engaging the downwardly facing locking shoulder surface 22*f* of the landing nipple which stops the upward movement of the keys holding the plug at the landing nipple with the keys expanded as shown in FIG. 6A into the locking recesses of the nipple. Upward force is continued on the handling string 29 to expand the seal 100 within the landing nipple and lock the plug at the nipple. The shear pin 72 is weaker than the shear pin 60 so that the pin 72 shears initially releasing the outer mandrel 52 to be pulled upwardly by the handling tool 24 to the position illustrated in FIGS. 7A and 7B. The mandrel 52 is released when the pin 72 breaks so that the mandrel 52 is lifted within the member 71, the sleeve 83 supporting the keys 85, and the seal 100. The member 71, the sleeve 83, and the keys 85 cannot move upwardly as the keys are locked in the landing nipple. The upward movement of the outer mandrel 52 lifts the locking balls 70 which are confined between the member 101 and the inner mandrel since the balls are below the recess 50. The upward force on the balls 70 raises the member 101 against the lower end of the seal 100. The upper end of the seal cannot move upwardly since the keys are holding the member 84 against upward movement so that the seal is expanded radially outwardly as shown in FIG. 7B engaging the inner wall surface along the casing landing nipple recess to seal around the plug mandrel 52 with the landing nipple recess wall. The mandrel 52 is lifted within the slips 75 which are wedged downwardly and inwardly by the spring 80 against the outer wall surface of the mandrel. The slips lock the mandrel against downward movement so that the mandrel is held upwardly to keep the seal 100 in compression expanded outwardly. When the seal 100 is fully expanded the upward force on the handling tool shears the pin 60 releasing the handling tool and string 29 from the plug 23 so that the tool and string are lifted upwardly leaving the plug in the casing landing nipple. FIG. 7A illustrates the lifting of the handling tool from the upper end of the plug mandrel after the pin 60 has sheared. Also in FIG. 7A the upward movement of the mandrel 52 will be evident from the two portions of the shear pin 72, the inner portion being displaced upwardly from the outer portion showing the upward movement of the mandrel. As the outer mandrel 52 is lifted the inner mandrel 34 is raised with the outer mandrel by the pin 111 since there is no force at this time resisting the upward movement of the inner mandrel. Since the outer and inner mandrels go up together they remain in the same longitudinal relationship so that the locking balls 70 remain confined between the mandrels holding the member 101 at an upper end position to retain the seal 100 in the compressed expanded condition of FIG. 7B. The nose 103 is solid below the side portion 110 and since the seals 51 remain engaged with the inner wall of the nose and the seals 45 are in contact with the outer mandrel bore portion 61 the expendable plug 23 fully closes the bore of the casing landing nipple 22 to shut off the lower portion 20*b* of the well bore retaining such well bore portion under the pressure of the air drilling fluid.

After removal of the handling string 29 and the running tool 24 from the well bore the surface end of the well bore is opened bleeding down the air pressure within the upper portion 20a of the well bore above the plug 23. The upper end of the well bore is opened to permit installation of the liner 31 which can be of very substantial length such as 2000 feet. The expending shoe 32 is secured on the lower end of the bottom section of the liner 31 as illustrated in FIG. 8C. The expending shoe comprises the retainer 185, the housing 180, and the collet 191. The housing 180 is threaded to the lower end portion of the bottom liner section. The liner is then assembled section by section as the liner string is lowered in the well bore until a sufficient length of liner string has been suspended in the well bore at which time the upper end portion of the top liner section is secured by threading onto the lower end portion of the liner hanger mandrel 122 as represented in FIGS. 8B and 8C. The liner hanger is then assembled with the handling tool 25 by insertion of the handling tool into the guide head 125 of the hanger until the J-slot 172 is engaged with the handling lug 124 as seen in FIG. 8A. The expending shoe, the liner, and the liner hanger are thus supported in an assembled relationship from the handling tool 25 as they are lowered on the handling string 29 into the upper portion of the well bore. When the hanger 30 is within the upper casing 21 below the wellhead, not shown, blowout preventers at the wellhead are closed around the handling string so that the well may be pressure controlled after the plug is expended opening well pressure into the upper well bore portion. The liner is then lowered on the work string. When the expending shoe telescopes downwardly over the upper end of the mandrel 34 of the plug 23 the collet 191 of the expending shoe snaps into the locked relationship on the plug mandrel shown in FIG. 8C. The collet 191 is pushed upwardly to the position illustrated at which the collet finger heads 194 are free to expand outwardly to snap over the mandrel head downwardly into the locked relationship illustrated. A downward force applied by the liner string and expending shoe on the inner mandrel 34 shears the pin 111 permitting the inner mandrel to be driven downwardly to the lower end position illustrated in FIG. 8D at which the recess 50 of the inner mandrel is aligned with the locking balls 70. The camming force of the member 101 on the locking balls caused by the expanding tendency of the compressed seal 100 forces the balls 70 radially inwardly into the recess 50 so that the member 101 is free to move downwardly on the outer mandrel 52 relaxing the seal 100 so that the seal contracts. As the mandrel 34 is pushed downwardly after the shearing of the pin 111 the seals 45 on the mandrel move downwardly into the larger bore portion 63 of the outer mandrel 52 so that the higher air pressure below the plug 23 is applied through the side port 110 in the nose 103 and upwardly past the seals 45 along the annulus between the inner and outer mandrels 34 and 52 to equalize the pressure across the plug 23 between the higher pressure lower portion **20*b* of the well bore and the upper portion 20*a* of the well bore. The pressure equalization occurs before displacing the plug 23 downwardly from the casing landing nipple. Continued downward force by the liner on the expending shoe after the relaxation of the seal 100 causes the keys 85 to be compressed inwardly as the downwardly sloping faces on the keys engage the downwardly sloping landing nipple recess surfaces. As soon as the keys are compressed inwardly to the position of FIG. 8D the plug 23 is released from the landing nipple and the plug, the liner, and the liner hanger continue downward movement as represented schematically in FIG. 4 showing the liner and expendable plug moving into the lower air drilled bore portion 20*b*. The plug 23 does not drop freely in the well bore but rather is suspended and remains suspended by means of the collet 191 from the lower end of the expending shoe 32.**

Figure 5:
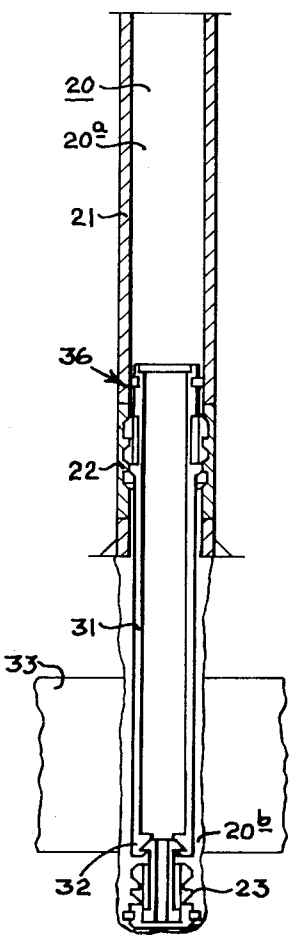
FIG. 5 is a schematic view similar to FIGS. 1–4 showing the apparatus of the invention fully installed in a well bore.

The displaced plug 23 supported from the suspending shoe 32, the liner 31, and the liner hanger 30 are lowered by means of the handling tool 25 until the keys 153 of the liner hanger reach and expand into the locking recesses of the landing nipple 22 as illustrated in FIG. 9. Since the key bosses are compatible with the two upper landing nipple recesses **22*b* and 22*c* the keys readily expand into the recesses when they are aligned with the recesses. The downwardly facing lock shoulder 153*a* on the keys engages the upwardly facing lock shoulder 22*e* of the landing nipple so that no further downward movement of the keys can occur. Downward force on the handling tool applied to the upper end of the liner hanger at the handling lug 124 forces the head member 123 downwardly driving the mandrel 120 downwardly while the keys 153 are held against downward movement. The members 150 and 140 together with the expandable seals 134 are held against downward movement by the expanded locked keys. The pin 151 shears releasing the mandrel 120 with the head 123 to move downwardly expanding the seals 134 and driving the mandrel locking flange 171 behind the lower ends of the keys 153 while the head portion 122*a* of the mandrel section 122 moves behind the upper ends of the keys as shown in FIG. 10B. The spring biased slips 143 engage the outer surface of the mandrel section 121 thereby locking the mandrel 120 at the lower position of FIG. 10B so that the seals 134 are expanded in sealed relationship with the inner wall surface of the landing nipple and the keys 153 are locked outwardly. The liner is thus suspended as schematically shown in FIG. 5 from the liner hanger with the annulus around the upper end of the liner at the hanger being sealed by the expanded seals 134 so that production of well fluids into the casing of the well bore must occur through the slots in the liner 31. The plug 23 remains suspended from the expending shoe at the lower end of the liner as seen in FIG. 5. The running string is then disengaged from the liner hanger by rotation until the vertical open J-slot portion of the slot 172 is aligned with the handling lug 124 so that the handling tool 25 is lifted freely upwardly from the upper end of the liner hanger 30.** The handling tool and string are withdrawn from the well bore which is thereafter fitted out as desired for fluid production from the well.

Thus in accordance with the apparatus of the invention a well bore is drilled by conventional means and processes through earth formations which are compatible with conventional liquid drilling fluids following which a suitable conventional well casing is installed including a casing landing nipple at the lower end of the casing string. The well is thereafter dried out and drilled by air drilling techniques through troublesome formations which are affected by water contained in conventional drilling fluids. Following the air drilling the well is plugged at the casing landing nipple by an expendable plug to confine the air drilling fluid pressure and any formation pressure within the lower air drilled portion of the well bore while the upper portion of the bore is opened to the atmosphere for running in the string of slotted liner. Without keeping the lower portion of the well bore sealed off by the plug, the liner, which may be several thousand feet long, could not be run into a well under pressure. An assembly including the expendable shoe, the required length of slotted well liner or casing, and the liner hanger are assembled and lowered into the well bore. The expendable plug is engaged by the expending shoe, supported in the shoe, and pushed downwardly from the casing landing nipple. The liner supported from the hanger with the expending shoe and displace plug are lowered until the hanger is in locked relationship in the casing landing nipple. The precompletion of the well is thus finished and the well may be properly fitted for production which may include the lowering of production tubing, valves, and related structure necessary to properly flow and control well fluids coming from the formation upwardly through the well bore.

What is claimed is:

1. A casing hanger for supporting a string of lower casing from a landing nipple secured in a string of upper casing in a well bore, said hanger comprising: a body mandrel having means at an upper end thereof for engagement of a running tool and means at a lower end thereof for connection with an upper end of a string of well casing; an expandable seal on said body mandrel for sealing around said hanger within a landing nipple; locating and locking keys on said body mandrel for locating said hanger at a landing nipple and locking said hanger against downward movement in said landing nipple; said body mandrel being movable relative to said seal and said locating and locking keys, said mandrel having means thereon to permit said locating and locking keys to expand and contract radially at a first upper position of said body mandrel and for locking said keys outwardly at upper and lower ends of said keys at a lower position of said body mandrel; means including an operation shoulder on said body mandrel for compressing and expanding said seal responsive to downward movement of said body mandrel relative to said seal and said locating and locking keys; means between said locating and locking keys and said body mandrel releasably holding said body mandrel against movement relative to said locating and locking keys at a first upper position of said body mandrel and adapted to permit said body mandrel to move downwardly for expanding said seal and locking said keys outwardly responsive to a force applied to said body mandrel; and means connected with said locating and locking keys for holding said body mandrel at said lower position for maintaining said seal expanded and said keys locked outwardly.

2. A casing hanger for supporting a string of lower casing from a landing nipple in accordance with claim 1 wherein said means for locking said keys outwardly at upper and lower ends of said keys at a lower position of said body mandrel comprises longitudinally spaced external annular bosses on said body mandrel positioned to move behind said keys when said body mandrel is moved downwardly to a key locking and seal expanding position.

3. A casing hanger for supporting a string of lower casing from a landing nipple in accordance with claim 2 wherein said means for holding said body mandrel at said lower position includes an annular slip retainer supported on said body mandrel between said keys and said seal and provided with an internal annular recess having an upwardly converging locking surface therein, a plurality of slips disposed in said recess of said slip retainer for movement along said convergent locking surface, and a spring within said recess biasing said slips toward said locking surface for locking said body mandrel at said lower position for maintaining said seal expanded and said keys locked outwardly.

4. A well liner hanger for supporting a string of well liner from a landing nipple secured in a well bore, said hanger comprising: a tubular body mandrel; means at the upper end of said body mandrel for releasable engagement of a handling tool with said hanger; means provided on a lower end of said body mandrel for connection with the upper end of a string of well liner to be supported from said body mandrel in a well bore; an expandable annular seal assembly slidably fitted on said body mandrel for sealing around said hangar within a landing nipple in a well casing; means providing an annular operating shoulder on said body mandrel engageable with a first end of said seal assembly for expanding said seal assembly responsive to movement of said body mandrel in said seal assembly toward the opposite second end of said seal assembly; an annular latch assembly on said body mandrel at said second end of said seal assembly for locking said body mandrel against movement of said body mandrel toward said first end of said seal assembly and for holding said seal assembly as said body mandrel moves in said seal assembly toward said second end of said seal assembly, said latch assembly including an annular slip retainer ring spaced concentrically around said body mandrel and having an end edge surface engaged with said second end of said seal assembly and an internal annular slip locking surface sloping inwardly toward said body mandrel and second end of said seal assembly, a plurality of slips disposed in circumferential spaced relation around said body mandrel within said slip retainer ring between said locking surface and the outer surface of said body mandrel, each of said slips having a sloping outer arcuate surface mating with and slidable along said slip retainer ring locking surface and an internal cylindrical surface portion provided with arcuate teeth for engaging the outer surface of said body mandrel to hold said body mandrel against movement toward said seal assembly; a spring within said slip retainer ring confined between said slips and a shoulder surface provided on said body mandrel for urging said slips toward said locking surface in said retainer ring to bias said slips toward locking engagement with the outer surface of said body mandrel; a tubular locking key mandrel supported in slidable relationship on said body mandrel and connected at a first upper end with a lower end portion of said slip retainer ring, said key mandrel having circumferentially spaced windows therein; means releasably locking said key mandrel with said body mandrel; a radially expandible and contractable locating and locking key disposed in each of said windows of said key mandrel, each of said locking keys having an external locking shoulder for engagement with a locking shoulder in a landing nipple to hold said hanger against movement in a first direction and each of said keys having an external locating profile engageable in a mating profile in a landing nipple in a well bore, said keys being adapted to engage a desired landing nipple along a well bore and lock said hanger against downward movement at said landing nipple in said well bore; a spring secured between each of said keys and said body mandrel for biasing each of said keys outwardly on said body mandrel, said keys being mounted on said body mandrel for movement between contracted release positions and fully expanded locking positions on said body mandrel at a first upper position of said body mandrel within said keys; said body mandrel being provided with longitudinally spaced external annular locking boss surfaces engageable with upper and lower internal end position surfaces in said keys for locking said keys in expanded locking positions upon movement of said body mandrel within said keys to a second lower position; and said keys when expanded in locking relationship at a landing nipple being adapted to hold said hanger against downward movement in said landing nipple and to lock said slip retainer ring against movement for expanding said seal assembly and holding said seal assembly expanded responsive to longitudinal movement of said body mandrel within said seal assembly, said slip locking assembly, and said keys whereby said body mandrel is moved to said second lower position and said keys are locked outwardly, said locking slips are urged against said body mandrel to hold said body mandrel against movement toward said assembly, and a downward force is applied to said seal assembly to hold said assembly expanded in a sealing relation with said landing nipple.

* * * * *

UNITED STATES PATENT AND TRADEMARK OFFICE

CERTIFICATE OF CORRECTION

PATENT NO. : 4,051,896

DATED : October 4, 1977

INVENTOR(S) : Amareswar Amancharla and Carter R. Young

It is certified that error appears in the above-identified patent and that said Letters Patent are hereby corrected as shown below:

Column 4, line 14, cancel "bail" and insert --ball--.

Column 7, line 41 cancel "conncted" and insert --connected--.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*